United States Patent [19]

Pansini

[11] 4,086,933

[45] May 2, 1978

[54] AUTOMATIC POOL CLEANER SYSTEM WITH TIMER DEVICE

[76] Inventor: Andrew L. Pansini, 180 Los Cerros Dr., Greenbrae, Calif. 94904

[21] Appl. No.: 719,903

[22] Filed: Sep. 23, 1976

Related U.S. Application Data

[62] Division of Ser. No. 565,805, Apr. 7, 1975, Pat. No. 4,007,749.

[51] Int. Cl.[2] ..... A01G 27/00

[52] U.S. Cl. ..... 137/119; 137/624.14; 134/56 R; 239/66

[58] Field of Search ..... 239/66; 134/56 R, 167 R, 134/168 R; 137/119, 624.14, 625.15, 625.46, 625.16, 630.17

[56] References Cited

U.S. PATENT DOCUMENTS

| | | | |
|---|---|---|---|
| 2,589,650 | 3/1952 | Wolcott, Jr. | 137/119 |
| 2,631,003 | 3/1953 | Heinz, Sr. | 137/625.16 |
| 2,642,076 | 6/1953 | Tigert et al. | 239/66 |
| 2,781,050 | 2/1957 | Edwards | 137/119 |
| 3,108,609 | 10/1963 | Schroder | 239/66 |
| 3,181,551 | 5/1965 | Coletti | 137/119 |
| 3,392,738 | 7/1968 | Pansini | 134/167 R |
| 3,730,208 | 5/1973 | Lewis | 137/119 |
| 3,779,269 | 12/1973 | Gould | 137/624.14 |
| 3,827,459 | 8/1974 | Hunter | 137/624.14 |
| 4,003,402 | 1/1977 | Corliss et al. | 239/66 |

*Primary Examiner*—Alan Cohan
*Assistant Examiner*—H. Jay Spiegel

[57] ABSTRACT

A timer device is connected into the water supply hose of an automatic swimming pool cleaner to control the flow of water to the drive jets. The controlled flow varies over the range of full, restricted and minimum or no flow so that the speed of the cleaner may be varied. The timer device includes a bypass outlet which serves as another pool cleaning jet when the drive jets are turned off and which also serves to bodily move the timer device and to impart an axial shifting movement to the supply hose whereby the cleaner may be moved free of a trapped position before the next cycle of drive jet operation commences.

1 Claim, 4 Drawing Figures

AUTOMATIC POOL CLEANER SYSTEM WITH TIMER DEVICE

RELATED APPLICATION

This application is a division of my co-pending prior application Ser. No. 565,805, filed Apr. 7, 1975 for AUTOMATIC POOL CLEANER SYSTEM WITH TIMER DEVICE now U.S. Pat. No. 4,007,749.

SUMMARY OF THE INVENTION

An object of the invention is to provide a simple but efficient hydro-mechanical device to cyclically control the operation of a swimming pool cleaner.

A further object of the invention is the inclusion of such a device in the water supply hose for the cleaner so that the timer device itself will perform a pool wall cleaning function while it maintains the cleaner in a deactivated condition.

Still a further object of the invention is to so include such a device in a swimming pool cleaner system that it serves to axially move the water supply hose after it has turned the cleaner off.

These and other objects and advantages of the invention will be apparent from the following description taken in conjunction with the drawing forming part of this specification and in which.

Figure 1:
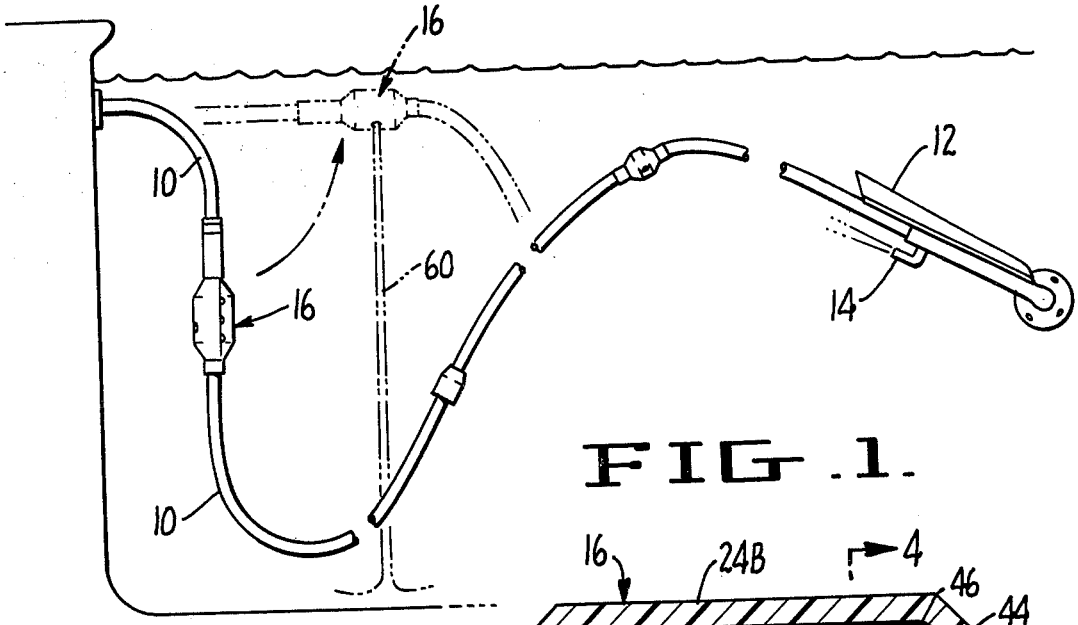
FIG. 1 shows a swimming pool provided with an automatic pool cleaner system which includes the timer device of the invention.

The swimming pool cleaner system of FIG. 1 comprises water supply hose 10, a carrier or transporter 12 for the free end of the supply hose, a drive jet 14 in communication with the supply hose, and the subject timer device 16 which is connected into the supply hose.

The inlet end of the timer is provided with a filter screen 18 and with an adjustable plug 20 whereby the water flow through the inlet passage 22 may be controlled. The timer device housing 24 is provided with an outlet passage 26 to which the water supply hose 10 is attached.

Within the housing 24 is a pair of plate members interconnected by posts having spacer sleeves 32. Between the two plates 28 and 30 are a water deflector member 34, a water wheel 36 and a valve member 38. The water wheel is fixedly secured to shaft 40 which in turn has fixedly secured to it gear pinion 42 constituting the input side of a gear reduction trail 44, the output gear 46 of which is fixedly secured to shaft 48 to which the valve element 38 is also fixedly secured. Shaft 40 and shaft 48 are journalled for rotation in plates 28 and 30. The intermediate members of the reduction gear train are free to rotate on either the stationary shaft 50 or shaft 48.

The valve element 38 comprises a closure member 52 for the housing outlet 26. The valve element 38 is further provided with a circular plate element 54 which is provided with a port 56. The housing 24 is provided with an outlet conduit 58, the inlet end of which is adapted to be closed by the plate element 54 and opened by the port 56 in that plate element.

The gear reduction train 44 comprises six successive stages of gearing stepdown (10 teeth on each pinion gear to 40 teeth on each large gear), thereby causing 4096 revolutions of water wheel 36 to impart one revolution to the valve element 38. A normal rate of water flow through the water supply line causes the water wheel to turn at about 1365 revolutions per minute. The outlet conduit 26 is therefore open for approximately 3 minutes and closed by the valve element 52 for about ¼ of a minute. As the conduit 26 closes, the housing bypass conduit 58 is opened by port 56, thereby causing a strong jet 58 of water (see FIG. 1) to issue from the bypass conduit 58. This drives the timer device 16 to the upper, horizontal, dotted line position shown in FIG. 1, thereby causing a substantial degree of axial shifting movement to be imparted to the water supply hose. Also, while the jet 60 issues from the bypass conduit 58 it sets up a powerful cleaning or scouring action in the pool bottom area beneath and adjacent to the timer device.

The adjustment plug 20 may be adjusted to control the amount of water delivered to the cleaner drive jet 14. The throttling down of flow through the timer device inlet 22 also serves to slow down the water wheel 36 and consequently increase the time of the overall cycle of operation of the valve element 38.

Figure 4:
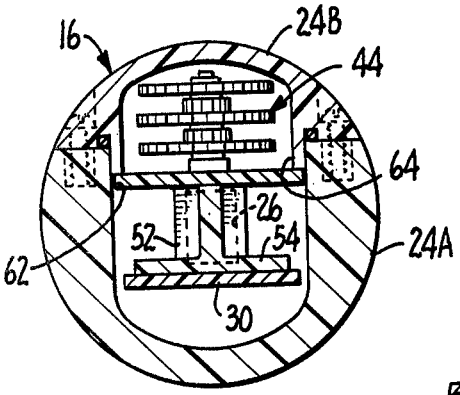
FIG. 4 is a view taken along lines 4—4 of FIG. 2.
Figure 3:
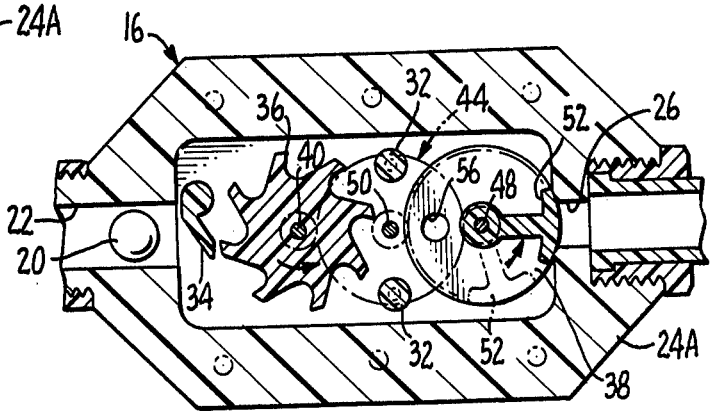
FIG. 3 is a view taken along lines 3—3 of FIG. 2.

As shown in FIG. 4, the housing 24 is made up of two separable parts 24A and 24B. The removal of housing part 24B enables access to and removement from the housing of the sub-assemblage comprising parts 28–54. This sub-assemblage is mounted within the housing by supporting plate 28 upon internal shoulder means 62 formed within housing part 24A and strip element 64 which is carried by housing part 24B and projects within housing part 24A.

Figure 2:
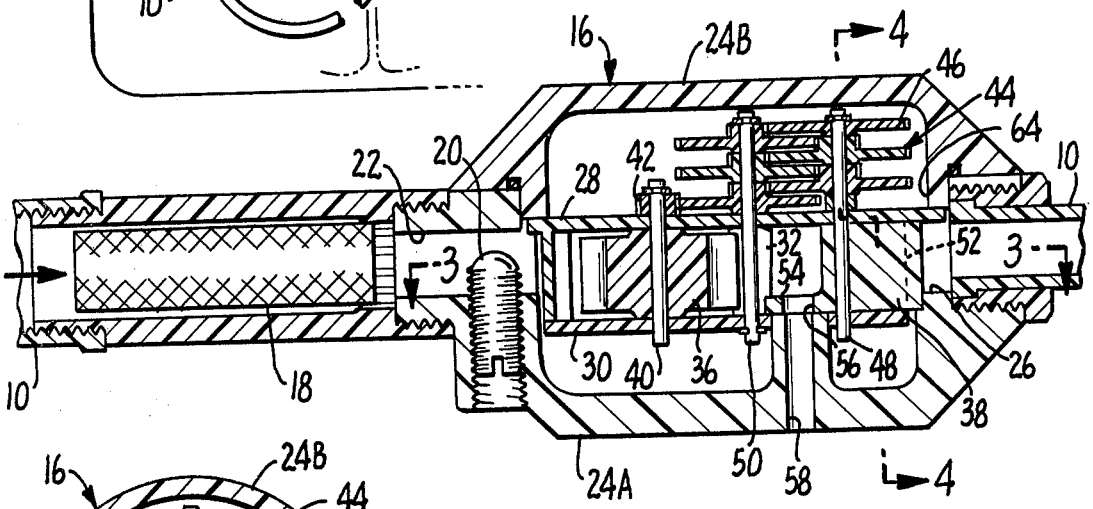
FIG. 2 is an enlarged view in transverse section of the timer device.

Plate 28 separates the housing cavity into two parts, with all of the water flow through the housing taking place (with reference to FIG. 2) below the plate 28. The gear train 44 is therefore not exposed to the flow of any water containing dirt which might foul or clog the gear train.

An important purpose and function of the timer device 16 is to serve as a means to vary the speed of movement of the cleaner head or transporter 12, thereby to effect a breaking of a possibly undesirably repetitious pattern of movement of the cleaner which does not permit every part of the pool to be covered. By slowing the cleaner down, i.e. when the valve element 52 commences to close the outlet conduit 26, and by speeding the cleaner up, i.e. during removal of the valve element 52 from the conduit, the cleaner is offered a movement pattern variance which can enable it to thoroughly cover the pool as it was intended to do.

What is claimed is:

1. A water flow control device for swimming pool cleaners comprising a housing having an internal compartment and having axially aligned water inlet and outlet openings therefor whereby said device is adapted to be connected into a water supply hose for a pool cleaner, a water wheel and means mounting it for rotation within said housing adjacent said inlet opening and in the path of water coming into said housing through said inlet opening, a wheel-like rotary multi-valving member and means mounting it for rotation within said housing adjacent said outlet opening and in the path of water flowing from said inlet to said outlet opening, said valving member comprising a plate valving element and an arcuate segmental valving element, the latter being associated with said outlet opening, a secondary discharge passageway formed in said housing terminating adjacent said plate valving element, a port in said plate element adapted to communicate with said secondary discharge passageway when water flow through said outlet opening is restricted by said arcuate segmental valving element and adapted to be out of communication with said secondary discharge passageway when said arcuate segmental valving element is in non-restricting relation to said outlet opening, a pair of spaced parallel plates positioned within said housing in laterally enclosing relation to said water wheel and said multi-valving member and serving to constrain the flow of water between said inlet and outlet openings, and means, including gear reducer means disposed within said housing and at the side of one of said plates opposite the side thereof at which said wheel and multi-valving member are located, driveably interconnecting said wheel and multi-valving member.

* * * * *